United States Patent [19]

Draxler

[11] 4,064,823

[45] Dec. 27, 1977

[54] ELECTRIC STARTER INTERLOCK FOR OUTBOARD MOTOR DEVICES

[75] Inventor: James Richard Draxler, Fond du Lac, Wis.

[73] Assignee: Brunswick Corporation, Skokie, Ill.

[21] Appl. No.: 709,448

[22] Filed: July 28, 1976

[51] Int. Cl.[2] ..... B63H 5/13; F02N 17/00

[52] U.S. Cl. ..... 115/17; 74/483 K; 123/179 SE; 123/179 K

[58] Field of Search ..... 115/17, 18 R, .5 R, 115/34 R; 74/483 R, 483 K, 850, 230.17 E; 123/179 K, 179 SE; D12/174, 179

[56] References Cited

U.S. PATENT DOCUMENTS

| | | | |
|---|---|---|---|
| 1,659,284 | 2/1928 | Smith | 74/483 |
| 2,987,934 | 6/1961 | Thomas | 74/230.17 E |
| 3,007,433 | 11/1961 | Seegrist | 115/18 R |
| 3,782,350 | 1/1974 | McBride | 123/179 SE |
| 3,866,591 | 2/1975 | Burmeister et al. | 123/179 K |

*Primary Examiner*—George E. A. Halvosa
*Assistant Examiner*—Gregory W. O'Connor
*Attorney, Agent, or Firm*—Andrus, Sceales, Starke & Sawall

[57] ABSTRACT

An outboard motor unit includes a shift lever pivotally mounted on a shaft to one side of powerhead with a central vertical neutral position and pivoted forwardly and rearwardly for forward and reverse drive. The unit includes an electric starter and a start pushbutton control mounted forwardly of the pivot shaft. The shift lever is formed with a forwardly projecting interlock plate having a central notch aligned with the button only in the neutral position. Forward or reverse pivoting causes the plate to move over the start button and prevents starting in other than neutral. The start button may be located such that the vertical lever moves over button in forward and a projecting plate moves over the button in reverse.

11 Claims, 5 Drawing Figures

ELECTRIC STARTER INTERLOCK FOR OUTBOARD MOTOR DEVICES

BACKGROUND OF THE INVENTION

This invention relates to an electric starter interlock for an outboard motor apparatus and particularly for preventing starting with the shift mechanism displaced from neutral.

Outboard motors are widely employed for the propulsion of recreational watercraft or boats and the like. The outboard motor generally includes an internal combustion engine mounted to the upper end of the drive shaft housing and coupled through a suitable drive coupling to a lower propeller unit secured to the bottom of the housing. A pivot bracket assembly secured to the housing is adapted to be pivotally interconnected to the transom of the boat. The drive coupling generally includes a shift mechanism for shifting between neutral, forward and reverse drive position for corresponding propulsion forces. A manually operable shift lever or handle is pivotally mounted to one side of the upper powerhead of the engine and pivoted forwardly and rearwardly for shifting to forward drive and reverse drive position, respectively.

Although many smaller outboards include manually operated rope mechanism, electric starters are also widely employed. Generally, the starter mechanism employs a starting gear secured to the upper end of the engine in combination with a spring-loaded pinion gear carried by a starter shaft. Energizing of the starter drives the pinion gear into starting engagement with the engine starting gear. A very convenient structure provides a push-button actuated switch which, when depressed, closes the starter circuit for engaging of the starting mechanism. The push-button is conveniently mounted directly on the side of the powerhead for manual operation by the operator. Small motors are generally controlled by manual operation of a tiller handle secured to the upper end of the powerhead. The shift control is conventionally a small lever pivotally mounted to the side of the powerhead opposite that of the tiller handle. It is important that the internal combustion engine be started with the drive coupling the neutral position to prevent sudden lurching of the boat, which may result from an attempt to start the engine with the coupling in a drive position.

Various protective devices generally include interlocking switch means connected in the energizing circuit for the electric starter. Alternately, various auxiliary mechanical linkages between the shift mechanism and the starter drive mechanism have also been suggested. For example, in an automotive environment, a flanged floor starter button in combination with a sliding cap which moves beneath such button and is coupled to the gear shift lever is shown in U.S. Pat. No. 1,659,284. In the outboard motor art, a latch member may be generally provided as shown in U.S. Pat. No. 3,782,350 to prevent the pinion from moving into engagement with the starter gear, for example, through a mechanical linkage connected to the shift mechanism. Although the various systems have provided satisfactory interlocks which prevent out-of-neutral starting, the special mechanisms not only contribute to initial cost but may require significant maintenance. The cost factor is of course related to the size and relative cost of the outboard unit. There is therefore a need for simple, reliable and low-cost interlock means which may be economically applied to outboard motors employing powerhead-mounted starter controls.

SUMMARY OF THE PRESENT INVENTION

The present invention is particularly directed to a simple, reliable and inexpensive electric starter and shift interlock apparatus for small outboard motors which positively prevents starting of the outboard engine except when the drive mechanism is in the neutral position.

Generally, in accordance with the present invention the shift lever is mounted for movement from the control position to a forward drive position and to a reverse drive position. The start control means is secured to the outboard unit in alignment with an interlock wall means of the lever in both forward or the reverse position of the lever and spaced laterally of such path of the lever. The lever is configured and constructed to expose the control means in the neutral position and to move into overlying covering position with the starter control means when moved to a drive position. The shift lever thus permits direct access to the start control means only when the lever is in the neutral position. The interlock apparatus is simple, reliable and relatively inexpensive. Thus, the push button or other control means can be readily mounted on the powerhead adjacent to the shift lever. The shift lever may be mounted in the conventional or desired manner, with only minimal and readily provided modification to properly function as the blocking member in all but the neutral position. As the shift lever is conventionally a plastic molded component, it can be readily constructed with the desired configuration and control or interlock portions.

More particularly, in a unique embodiment of the present invention, the shift lever is pivotally mounted on a shaft to one side of the outboard motor with a central vertical position establishing neutral drive and pivoted forwardly and rearwardly for shifting to the forward and reverse drive positions. The starter push button is mounted immediately forwardly of the lever pivot shaft. The shift lever is formed with a forwardly projecting interlock plate means having a central notch or opening aligned with the starter push button in the neutral position. The pivoting of the lever forwardly or rearwardly causes the plate means to move into overlying position over the push button and prevents access thereto. In an alternate construction, the push button is located such that the lever moves into overlying relationship with the starter push button for forward drive positioning and the lever includes a projection moved into overlying engagement with the starter push button with lever in the reverse drive position. Thus, the starter mechanism, the shift mechanism and steering controls may be constructed in accordance with well known designs widely employed in the industry and the interlock provided in accordance with the present invention by simple modification of the shift lever and the proper location of the starter control.

The present invention has been found to provide a simple and reliable interlock which minimizes the cost of the interlocking mechanism.

BRIEF DESCRIPTION OF THE DRAWING

The drawing furnished herewith illustrates a preferred construction of the present invention in which the above advantages and features are clearly disclosed as well as others which will be readily understood from the following description of the illustrated embodiment of the invention.

In the drawing.

DESCRIPTION OF THE ILLUSTRATED EMBODIMENT

Figure 1:
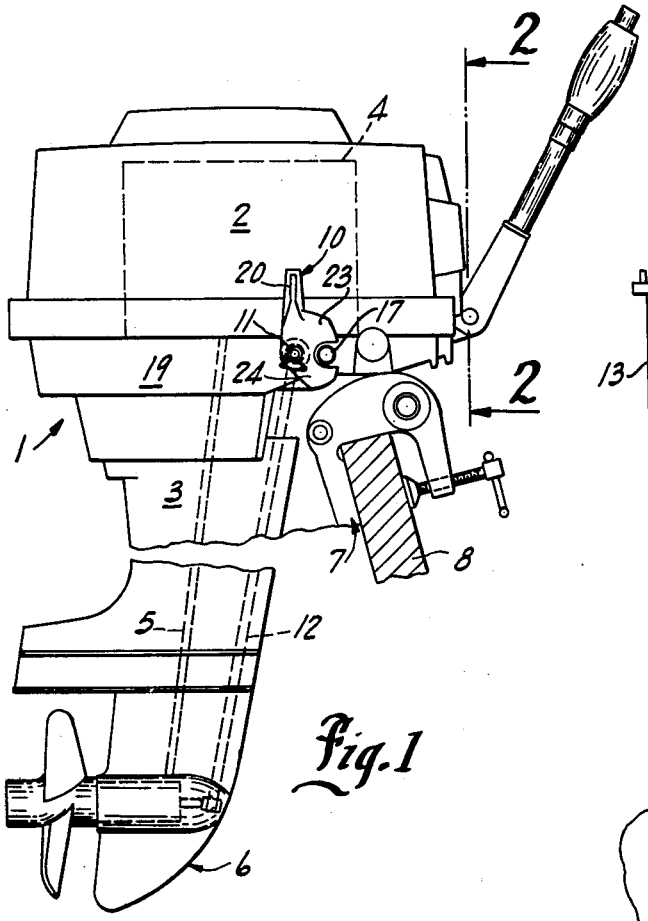
FIG. 1 is a side elevational view of an outboard motor showing a shift lever and start control in a preferred embodiment of the present invention.

Referring to the drawings and particularly to FIG. 1, an outboard motor 1 is illustrated of a more or less conventional construction including an upper powerhead 2 secured to the top wall of a pendant drive shaft housing 3. The powerhead 2 includes an internal combustion engine 4 which is coupled through a vertical drive shaft 5 to a propeller unit 6 secured to the lower end of the drive shaft housing 3. A bracket assembly 7 is secured to the drive shaft housing 3 for mounting of the outboard motor 1 on a boat transom 8.

A shift lever 10 is pivotally mounted to one side of the powerhead 2 for manual positioning between a vertical neutral position, a forward drive position and a reverse drive position. The lever 10 is secured to a pivot shaft 11 which is suitably rotatably mounted and coupled to a shift linkage 12 for selective coupling of the propeller unit 6 to the drive shaft 5. The shift linkage 12 and coupling may be of any suitable construction such as disclosed in U.S. Pat. No. 3,931,783 and no further detailed description is given other than as necessary to explain the illustrated embodiment of the invention.

Figure 4:
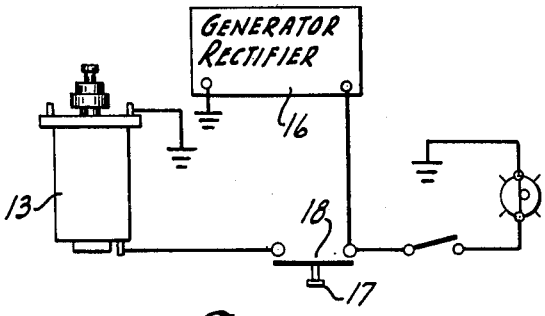
FIG. 4 is a simplified circuit diagram illustrating the circuit connection of an electric starting mechanism.
Figure 2:
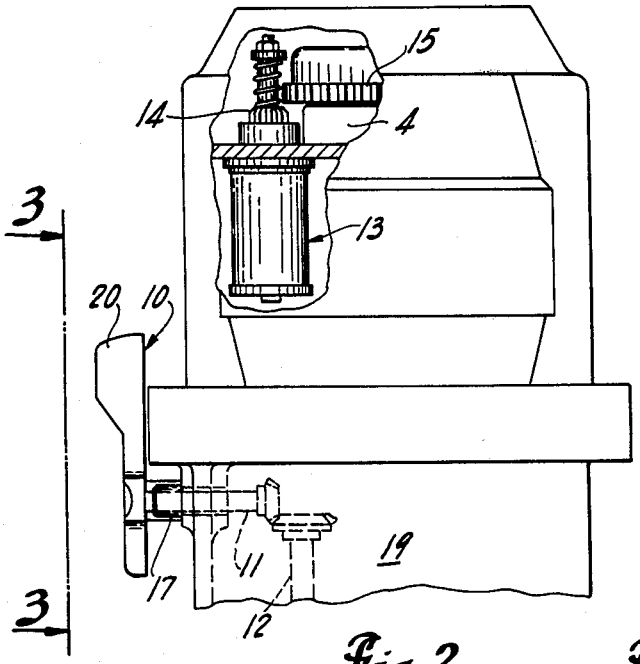
FIG. 2 is a fragmentary enlarged front view of FIG. 1 with parts broken away.

The illustrated engine 4 is preferably provided with an electrically driven starter mechanism 13 secured to the internal combustion engine 4 and adapted when actuated to move a pinion gear 14 into engagement with a starting gear 15 secured to the engine crankshaft, as shown in FIGS. 2 and 4. Mechanism 13 is connected to a suitable power supply such as a 12-volt battery 16 by actuation of a control button 17 which is uniquely located relative to the lever 10, and in turn actuates a start switch 18, for example, as shown in FIG. 4.

Figure 3:
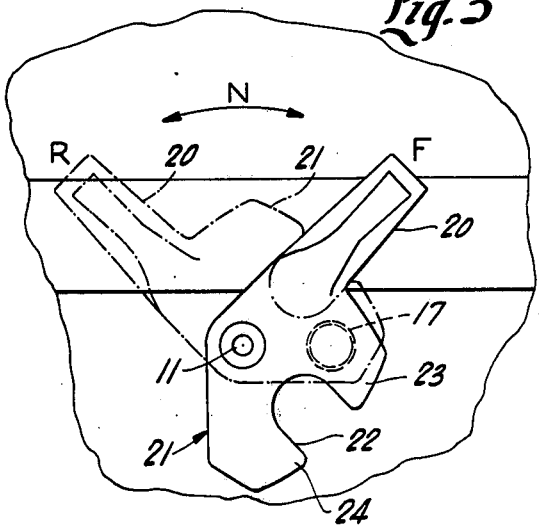
FIG. 3 is a fragmentary view showing alternate positions of a shift lever relative to the starter control.

In accordance with the illustrated embodiment of the present invention, main starter switch button 17 is mounted in the lower or bottom housing 19 of the powerhead unit 2 adjacent the shift lever 10 which is uniquely constructed to move into overlying engagement with the push button 17 in both forward and reverse drive positions as shown in FIGS. 2 and 3. More particularly, the shift lever 10 in the illustrated embodiment of the invention is formed as a generally L-shaped member which is pivotally mounted within the sidewall of the bottom housing 19. This lever 10 is coupled to the pivot shaft 11 and rotates the mechanical linkage 12 to effect shifting between a neutral forward and reverse drive positions. In the neutral position, a long leg 20 of lever 10 is vertically located and defines a handle which is manually moved forward to effect a forward drive condition and similarly moved rearward to effect a reverse drive condition.

The starter button 17 is located immediately adjacent to the shift lever 10 and generally in alignment with the pivot shaft 11. In the illustrated embodiment, the lever 10 further includes an integral laterally extended interlock arm 21 which is generally a plate-like member having a central opening 22 aligned with the start button 17 with the lever 10 in the neutral position. This exposes the start button 17 for starting of the engine in neutral. The interlock arm 21 includes upper and lower walls 23 and 24 which are spaced outwardly of the outermost portion of button 17 and moved into overlying alignment with the start button 17 whenever the lever 10 is shifted to a drive position. Thus, forward pivoting of the lever 10 to a forward drive position causes the upper wall 23 to move into overlying alignment with the start button 17; positively limiting and practically preventing access thereto, as shown in FIG. 3. Conversely, reverse positioning of the lever to the reverse drive position causes the lower wall 24 to move into overlying alignment with the starter button 17, as shown in FIG. 3, to prevent access thereto. The proper location of the starter control is readily made and the modified shift lever 10 can be constructed at very minimal additional cost as a molded member and in accordance with normal production procedures. The structure of the present invention thus avoids provision of additional elements and particularly any complex and costly linkage components and the like.

Figure 5:
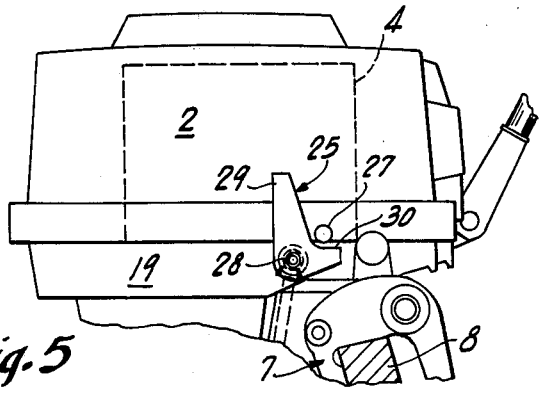
FIG. 5 is a view similar to FIGS. 2 and 3 of an alternate embodiment of the invention.

Although shown in a preferred construction, other forms might be employed. For example, a simple L-shaped lever 25, as illustrated in FIG. 5, can be employed. In this embodiment, the start button 27 is located slightly forwardly and also upwardly of the pivot shaft 28 for the modified shift lever 25. Positioning of the shift lever 25 to the forward position causes, the vertical arm 29 of lever 25 to move into overlying relationship to the start button 17. Opposite or reverse positioning of the lever 25 to the reverse drive position causes the base leg 30 of the L-shaped lever 25 to move into overlying relationship with the start button 27.

The starter interlock mechanism of this invention thus provides a simple and reliable means preventing starting the engine with the drive shifted from neutral.

Various modes of carrying out the invention are contemplated as being within the scope of the following claims, particularly pointing out and distinctly claiming the subject matter which is regarded as the invention.

We claim:

1. A marine propulsion device having an internal combustion engine, an outer enclosure for said engine, a shift mechanism, an electrically operated starter mechanism, a start control switch means having an external operator extending from the enclosure, said switch means controlling energization of the starter mechanism, and a shift lever movably mounted adjacent said external operator and having wall means positioned in overlying relation to said external operator in all positions other than the neutral position to thereby block access to the external operator except when the lever is in the neutral position.

2. A marine propulsion device having an internal combustion engine, a shift mechanism, an electrically operated starter mechanism, a start control, and a shift lever movably mounted adjacent said start control and having wall means positioned in overlying relation to said start control in all positions other than the neutral position to thereby block access to the start control except when the lever is in the neutral position, wherein said start control includes a push-button means and said shift lever is pivotally mounted and includes spaced wall means moved into said overlying relation to said push-button means.

3. A marine propulsion device having an internal combustion engine, an outer enclosure for said engine, a shift mechanism, an electrically operated starter mechanism, a start control switch means having an external operator extending from the enclosure, said switch means controlling energization of the starter mechanism, and a shift lever movably mounted adjacent said external operator and having wall means positioned in overlying relation to said external operator in all positions other than the neutral position to thereby block access to the external operator except when the lever is in the neutral position and including an upper powerhead support for said combustion engine and having an outer enclosure wall including a sidewall, said start control being located on said sidewall, and said shift lever being pivotally mounted in said sidewall immediately rearwardly of said start control.

4. In a marine propulsion apparatus having an internal engine mounted within an upper powerhead unit and connected to a lower propeller unit, said powerhead unit having an exterior enclosing wall, said engine having an electrically driven starter means and a shift mechanism having an input within the upper powerhead unit, a starter interlock mechanism comprising a manually operable start control means located in an exterior wall of the powerhead unit, a shift lever means pivotally mounted immediately adjacent to said starter control means and being reversibly movable in opposite directions from a neutral position to a forward drive position and a reverse drive position, said lever means being formed with a plurality of wall portions separated by an open portion and arranged with the open portion aligned with the start control means in the neutral position and moving into overlying alignment to the start control means in both said forward and reverse positions of said lever means and thereby preventing starting the internal combustion engine in other than the neutral position.

5. The marine propulsion apparatus of claim 4 wherein said lever means is a generally L-shaped member having a handle located in a vertical and centered neutral position and movable forwardly and rearwardly to establish a corresponding forward and reverse drive condition.

6. In the marine propulsion apparatus of claim 4 wherein said manually operable start control means includes a push button means mounted for movement in said exterior wall, said shift lever means including an elongated handle portion and said plurality of spaced portions secured to said handle portion and projecting forwardly therefrom toward the push button means and spaced from each other along the handle.

7. The marine propulsion apparatus of claim 4 wherein said lever means is L-shaped having a vertical handle arm and an offset interlock arm and pivotally mounted at the common connection of the two arms, said handle arm and said interlock arm moving correspondingly into overlying alignment to the start control means in said forward position and reverse positions of said lever.

8. In a marine propulsion apparatus including an internal combustion engine mounted within an upper powerhead unit and having a reversing transmission shiftable from a neutral position to a forward drive position and a reverse drive position, a shift linkage having a rotatable pivot shaft located in the upper powerhead unit in combination with an electrically driven starter mechanism comprising a shift lever pivotally mounted to one side of the upper powerhead unit and connected to said pivot shaft, said shift lever having a vertically located handle arm in the neutral shift position and movable forwardly to an inclined position to effect said forward drive position and pivotal to a corresponding rearward inclined position to establish said reverse drive position, a start control button reciprocally mounted in the upper powerhead unit, said start control button being located forwardly of the said pivot shaft, and said lever being mounted outwardly of the outermost end of the push button and having a forwardly projecting interlock arm, said button being spaced from said arms in only the neutral position of said lever and covered by one of said arms in forward and reverse drive positions.

9. The marine propulsion apparatus of claim 8 wherein said lever is an integral plastic member having a mounting hub at the common junction of said arms.

10. The marine propulsion apparatus of claim 8 wherein said start control button being located forwardly and upwardly of the said pivot shaft between said handle arm and said interlock arm in the neutral position of the shift lever, said handle arm defining an upper interlock wall located in overlying alignment to said push button with the lever in forward drive position, said interlock arm defining a lower interlock wall in overlying alignment to said start button with said shift lever in reverse position.

11. The marine propulsion apparatus of claim 8, wherein said start control button is located forwardly of said pivot shaft, and said interlock arm is generally a U-shaped member including a centrally located opening aligned with the start button with the lever in the neutral position, said U-shaped member defining an upper interlock wall in overlying alignment to said push button with the lever in forward drive position, said U-shaped member defining a lower wall in overlying alignment to said start button with said shift lever in reverse position.

* * * * *